US007601027B2

(12) United States Patent
Rosenberger

(10) Patent No.: US 7,601,027 B2
(45) Date of Patent: Oct. 13, 2009

(54) COAXIAL BUSHING CONNECTOR HAVING AIR DIELECTRIC WITHIN A PREDEFINED SEGMENT

(75) Inventor: Bernd Rosenberger, Tittmoning (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 12/088,874

(22) PCT Filed: Oct. 2, 2006

(86) PCT No.: PCT/EP2006/009549

§ 371 (c)(1),
(2), (4) Date: Apr. 1, 2008

(87) PCT Pub. No.: WO2007/039269

PCT Pub. Date: Apr. 12, 2007

(65) Prior Publication Data

US 2008/0254668 A1 Oct. 16, 2008

(30) Foreign Application Priority Data

Oct. 4, 2005 (DE) ..... 20 2005 015 509 U

(51) Int. Cl.
*H01R 9/05* (2006.01)

(52) U.S. Cl. ..... 439/578

(58) Field of Classification Search ..... 439/578, 439/579, 580, 581, 582, 583, 584, 585, 335
See application file for complete search history.

(56) References Cited

U.S. PATENT DOCUMENTS 5,196,789 A * 3/1993 Golden et al. ..... 324/761
6,602,093 B1 * 8/2003 Cannon ..... 439/578
6,609,925 B1 * 8/2003 Cannon ..... 439/332
6,808,407 B1 10/2004 Cannon
6,884,099 B1 * 4/2005 Cannon ..... 439/318
7,354,289 B2 * 4/2008 Cannon ..... 439/314

FOREIGN PATENT DOCUMENTS

DE 4203945 C1 1/1993
DE 10306053 A1 11/2003
FR 2222768 A 10/1974
GB 2066588 A 7/1981

* cited by examiner

*Primary Examiner*—Chandrika Prasad
(74) *Attorney, Agent, or Firm*—DeLio & Peterson, LLC; Robert Curcio

(57) ABSTRACT

The invention relates to a coaxial bushing connector (10) comprising an outer conductor part (12), an inner conductor part (14), a first end (18) for attaching a coaxial plug connector, a second end (20) lying opposite the first end, in particular for connecting to a coaxial cable or to a printed circuit board, and an electrical and mechanical reference plane (16), the outer conductor part between the first end of the coaxial bushing connector and the electrical and mechanical reference plane matching the BNC standard. The coaxial bushing connector is designed in such a way that at least between the electrical and mechanical reference plane on the one hand and the second end of the coaxial bushing connector on the other hand the inner conductor part and the outer conductor part form between them over at least one predefined section a 7 mm coaxial line, an outer conductor of the outer conductor part having an inner diameter of 7 mm and an inner conductor of the inner conductor part having an outer diameter of 3.05 mm and air being present as a dielectric between the inner and outer conductors.

8 Claims, 2 Drawing Sheets

COAXIAL BUSHING CONNECTOR HAVING AIR DIELECTRIC WITHIN A PREDEFINED SEGMENT

This application is a U.S. National Filing pursuant to 35 U.S.C. § 371 of PCT/EP2006/009549, which was filed on Oct. 2, 2006, and claims priority from DE 20 2005 015 5098, which was filed on Oct. 4, 2005.

BACKGROUND OF THE INVENTION

1. Field of the Invention

The present invention relates to a coaxial connector having an outer conductor part, an inner conductor part, a first end for attaching a coaxial plug connector, an end situated opposite to the first end, particularly for connecting to a coaxial cable or a printed circuit board, and an electrical and mechanical reference plane, wherein the outer conductor part between the first end of the coaxial bushing connector complies with the BNC standard. The invention further relates to a coaxial plug connector for connecting to the aforementioned coaxial bushing connector, wherein the coaxial plug connector comprises an outer connector part and an inner connector part and the outer conductor part complies with the BNC standard.

2. Description of the Related Art

The BNC connector (Bayonet Navy Connector) disclosed by DE 103 06 053 A1, for example, is well known for HF connections and comply in their dimensions with a predefined BNC standard. A particular advantage of BNC connectors is their simple applicability. The BNC plug is pushed into the BNC bushing and electrically and mechanically connected with a simple quarter turn. This simple handling, however, is associated with limited electrical characteristics. Accordingly, the transmission bandwidth in HF applications is limited to approximately 3 GHz. In precision measurement engineering such as in network analysers or in high-frequency oscilloscopes, for example, a plug connectors at signal input and outputs require bandwidths of up to 20 GHz. Previously, this resulted in plug connectors on measurement at the inputs of precision measurement instruments being specially equipped, in order to satisfy the requirements with respect to electrical characteristics. However, if one wanted to use a cost-effective measurement instrument for applications with lower requirements with respect to measurement accuracy that use BNC connectors, costly retrofitting was previously required for instrument bushings, that adapt a connection of the BNC connectors to the cost-effective measurement equipment to the special instrument bushings of the precision measurement instrument.

BRIEF SUMMARY OF THE INVENTION

The invention proposes an improvement of a coaxial bushing connector or coaxial plug connector of the aforementioned type, in that the connector is universally applicable and can be used both with high-precision measurement instruments with high requirements with respect to electrical characteristics and with conventional measurement instruments with lower requirements with respect to electrical characteristics and does not require costly adapters.

This proposal is realised according to the invention by a coaxial bushing connector of the aforementioned type having the features characterised in claim 1 and by a coaxial plug connector of the aforementioned type having the features characterised in claim 5. Advantageous embodiments of the invention are described in the supplemental claims.

BRIEF DESCRIPTION OF THE SEVERAL VIEWS OF THE DRAWINGS

The invention is described in more detail with reference to the drawing. Wherein.

DETAILED DESCRIPTION OF THE INVENTION

Figure 1:
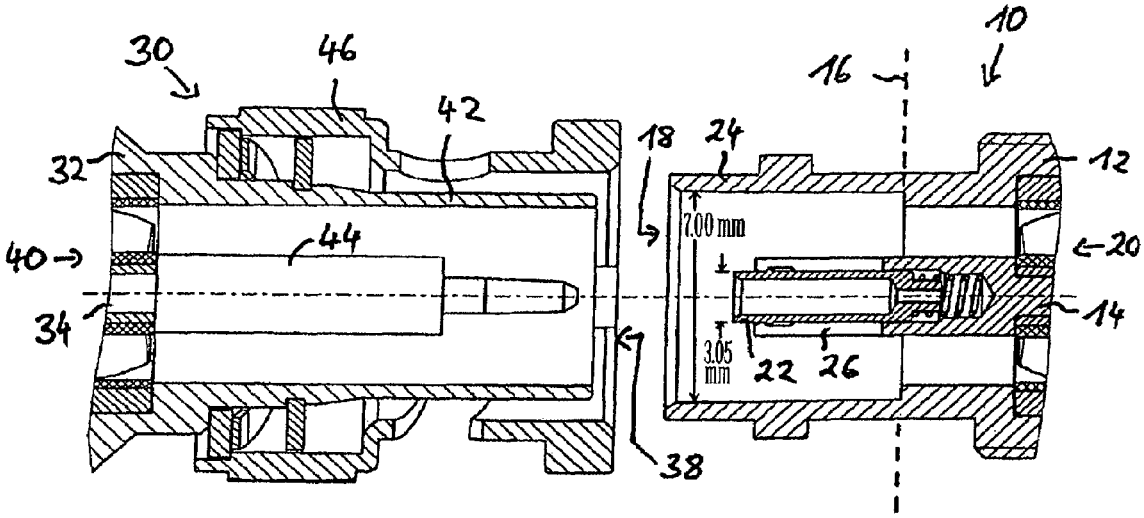
FIG. 1 diagrammatically represents a preferred embodiment of a coaxial bushing connector and a coaxial plug connector according to the invention in cross-section in the unplugged condition.

In a coaxial bushing connector of the aforementioned type the invention proposes that at least between the electrical and mechanical reference plane on the one hand and the second end of the coaxial bushing connector on the other hand, the inner conductor part and the outer conductor part form between them over at least one predefined segment a 7-mm coaxial line, wherein an inner diameter of an outer conductor of the outer conductor part is 7 mm and an outside diameter of an inner conductor of the inner conductor part is 3.05 mm and air is present as a dielectric between the inner and the outer conductor. This has the advantage that a BNC compatible coaxial bushing connector is available that can be attached in addition to the conventional BNC plugs also to specially adapted coaxial plug connectors that together with the coaxial bushing connector according to the invention, provides an elevated transmission bandwidth for high-frequencies. In other words, the novel coaxial bushing connector represents a high-quality connector with respect to HF-transmission that is downward compatible in the case where a lower transmission bandwidth is sufficient for an application with respect to conventional BNC plugs with lower bandwidth. Using the 7-mm coaxial line, the coaxial bushing connector has a high-precision HF-line, that in combination with an appropriate coaxial plug connector provides a high electrical quality plug connection with high transmission bandwidth for HF signals up to 20 GHz. At the same time, corresponding measurement standards are available for 7-mm coaxial lines that can be used.

Interference free plugging with simultaneously good electrical contact at the inner conductor is obtained in that an inner conductor bushing is arranged at the first end of the inner conductor part a that is axially displaceable relative to the inner conductor part, wherein a spring is arranged between the inner conductor bushing and the inner conductor part so that said spring exerts a force on the inner conductor bushing towards the first end of the coaxial bushing connector.

In a preferred embodiment, the inner conductor part is configured at the first end of the coaxial bushing connector and the inner conductor bushing is arranged axially in this hollow cylinder.

In particularly advantageous fashion, an inner diameter of the inner conductor bushing complies with the BNC standard.

In a coaxial plug connector of the aforementioned type, the invention provides that the inner conductor part and the outer conductor part of the coaxial plug connecter are configured so that these complement the outer conductor part and the inner conductor part when the coaxial plug connector is plugged into the coaxial bushing connecter, such that at least in the zone between the electrical and mechanical reference plane and the first end of the coaxial bushing connector a 7-mm coaxial line is formed, in which an inner diameter of the outer conductor of the outer conductor part is 7 mm and an outer diameter of the inner conductor of the inner conductor part is 3.05 mm and air is present as a dielectric between the inner and outer conductor.

This has the advantage that a HF plug connection is available with particularly good electrical properties of high transmission bandwidth for HF signals of up to 20 GHz. Because of the 7-mm coaxial lines, previously existing measurement standards can be used.

In one preferred embodiment, the inner conductor part and the outer conductor part of the coaxial plug connector are further configured so that when the coaxial plug connector is plugged into the coaxial bushing connector they form a 7-mm coaxial line over the entire axial length of the electrical and mechanical reference plane of the coaxial bushing connector up to an end of the coaxial plug connector facing away from the coaxial bushing connector.

The preferred embodiment of a coaxial bushing connector 10 shown in FIGS. 1 and 2 comprises an outer conductor part 12, an inner conductor part 14, an electrical and mechanical reference plane 16, a first end 18 for attaching a coaxial plug connecter (described in detail below), and a second end 20 arranged opposite to the first end 18 for connecting to a coaxial cable or to a printed circuit board (not shown). The inner conductor part 14 is configured at the first end 18 as a hollow cylinder into which an inner conductor bushing 22 is axially inserted. In addition, a helical spring is arranged in the hollow cylinder of the inner conductor part 14 which exerts a force on the inner conductor bushing 22 in the direction of the first end 18.

A section of the outer conductor part 12 between the first end 18 and the electrical and mechanical reference plane 16 of the coaxial bushing connector 10 is configured according to the BNC standard. Between the electrical and mechanical reference plane 16 and the second end 20 of the coaxial bushing connector 10, the outer conductor part 12 and the inner conductor part 14 form between them a so-called 7-mm coaxial line. In the case of this 7-mm coaxial line the inner diameter of an outer conductor 24 of the outer conductor part 12 is 7 mm and the outer diameter of an inner conductor 16 of the inner conductor part 14 is 3.05 mm, and air is present as a dielectric between the inner and outer conductor 24, 26. This results in a HF line having a wave resistance of 50Ω. In the zone between the electrical and mechanical reference plane 16 and the end 18 of the coaxial bushing connector 10, the inner conductor 26 has an identical outer diameter as in the zone of the 7-mm coaxial line and the outer conductor 24 has a larger inner diameter.

Figure 2:
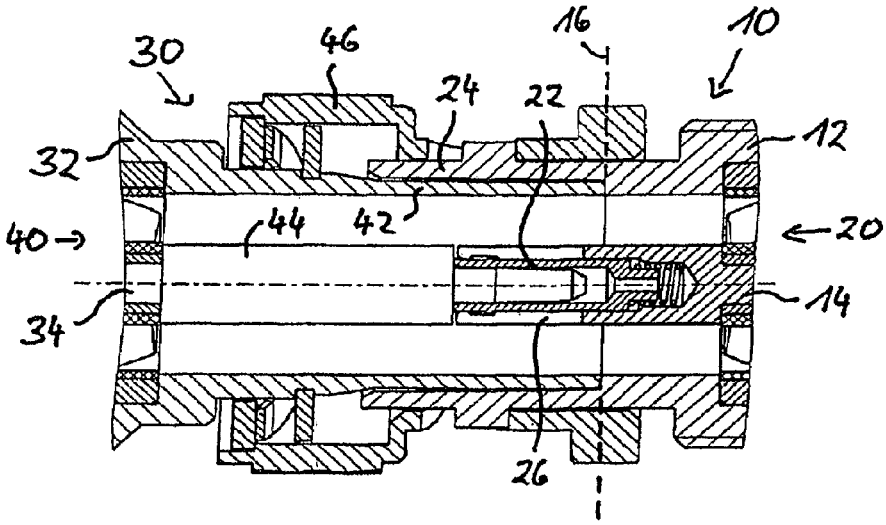
FIG. 2 diagrammatically represents a cross-section of the coaxial bushing connector and coaxial plug connector according to FIG. 1 plugged together.

The preferred embodiment of a coaxial plug connector 30 according to the invention shown in FIGS. 1 and 2 comprises an outer conductor part 32, an inner conductor part 34, a first end 38 for attaching the previously described coaxial bushing connector 10 and a first end 38 situated opposite to the first end 40, particularly for connecting to a coaxial cable or to a printed circuit board (not shown). The outer conductor part 32 of the coaxial plug connector 30 is configured according to the BNC standard so that it can be connected to the known bayonette fastening of the outer conductor part 12 of the coaxial bushing connector 10. The outer conductor part 32 of the coaxial plug connector 30 includes an outer conductor 42 and a bayonette bushing 46 and the inner conductor part 34 of the coaxial plug connector 30 comprises an inner conductor 44.

The larger—compared to the 7-mm coaxial line—inner diameter of the outer conductor 24 of the coaxial bushing connector 10 in the zone between the electrical and mechanical reference plane 16 and the first end 18 of the coaxial bushing connector 10 is used for receiving the outer conductor 42 of the coaxial plug connector 30 in the plugged condition, wherein the inner diameter of the outer conductor 42 of the coaxial plug connector 30 is configured so that together with the inner conductor 26 or the coaxial bushing connector 10 it forms a 7-mm coaxial line also in the zone between the electrical and mechanical reference plane 16 and the first end 18 of the coaxial bushing connector 10 and said coaxial line connects seamlessly to the 7-mm coaxial line of the coaxial bushing connector 10 between the electrical and mechanical reference plane 16 and the second end 20 of the coaxial bushing connector 10. Furthermore, the outer conductor 42 and the inner conductor 44 of the coaxial plug connector 30 are configured so that in the plugged-in condition they continue along said 7-mm coaxial line also extending from the first end 18 of the coaxial bushing connector 10 to the second end 40 of the coaxial plug connector 30. Overall, this results in a plug connection forming a 7-mm coaxial line over its entire length when the coaxial bushing connector 10 and the coaxial plug connector 30 according to the invention are plugged together.

Figure 3:
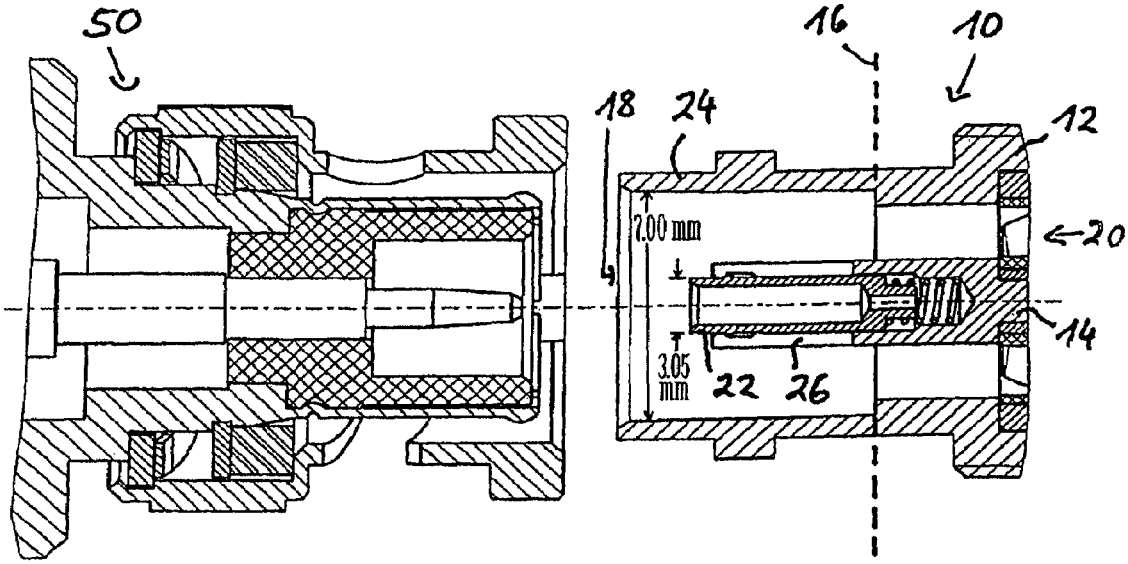
FIG. 3 diagrammatically represents a cross-section of a preferred embodiment of the coaxial bushing connector with a conventional BNC plug in the unplugged condition.
Figure 4:
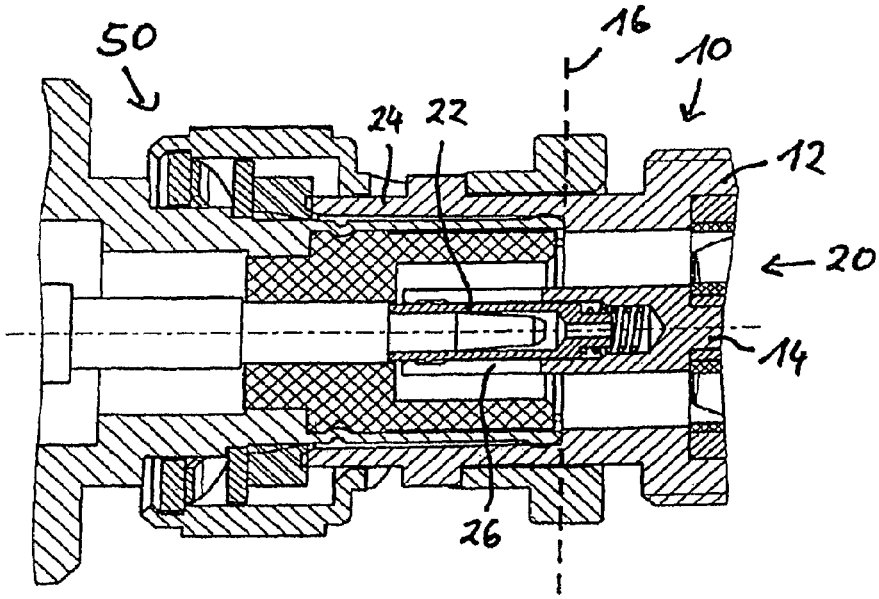
FIG. 4 diagrammatically represents a cross-section of the coaxial bushing connector with the conventional BNC plug according to FIG. 3 plugged together.

FIGS. 3 and 4 illustrate the inventive coaxial bushing connector 10 of FIGS. 1 and 2 together with a conventional BNC plug 50. As can be seen in FIGS. 3 and 4, this conventional BNC plug 50, too, can be plugged onto the coaxial bushing connector 10 according to the invention. Obviously, this plug connection does not have the good electrical characteristics of the plug connection represented in FIG. 2, but BNC plugs 50 as represented in FIGS. 3 and 4 are used only for applications with low requirements with respect to the electrical transmission properties such as the bandwidth for transmission of HF signals.

In a practical application the coaxial bushing connector 10 according to the invention is mounted on a test port of a measurement instrument, for example. Depending on the measurement task to be carried out or the resulting requirement with respect to electrical characteristics with respect to the plug connection a coaxial plug connector 30 according to the invention for high requirement with respect to the electrical characteristics (high bandwidth) or a conventional BNC plug 50 for lower requirements with respect to the electrical characteristics (low bandwidth). It is immediately apparent, however, that in the case of the conventional BNC plug 50 no additional retrofit plane is required on the coaxial bushing connector 10 according to the invention but the conventional BNC plug 50 can be attached directly to the coaxial bushing connector 10 according to the invention without any adaptation by additional equipment.

While the present invention has been particularly described, in conjunction with the specific preferred embodiment(s), it is evident that many alternatives, modifications, and variations will be apparent to those skilled in the art, in light of the foregoing description. It is therefore contemplated that the appended claims will embrace any such alternatives, modifications, and variations as falling within the true scope and spirit of the present invention. Thus, having described the invention,

What is claimed is:

1. A coaxial bushing connector comprising: an outer conductor part, an inner conductor part, a first end for attaching a coaxial plug connector, a second end opposite the first end, in particular for connecting to a coaxial cable or to a printed circuit board, and an electrical and mechanical reference plane, whereby the outer conductor part between the first end of the coaxial bushing connector and the electrical and mechanical reference plane complies with the BNC standard, characterized in that at least between the electrical and mechanical reference plane on the one hand and the second end of the coaxial bushing connector on the other hand the inner conductor part and the outer conductor part form between them and over at least one predefined segment a 7-mm coaxial line, wherein the inside diameter of an outer conductor of the outer conductor part is approximately 7 mm and an outside diameter of an inner conductor of the inner conductor part is approximately 3.05 mm and air is present as a dielectric between the inner and outer conductors.

2. The coaxial bushing connector of claim 1 including having an inner conductor bushing arranged at the first end of the coaxial bushing connector on the inner conductor part and said bushing of the inner conductor part is axially displaceable, whereby a spring is arranged between the inner conductor bushing and the inner conductor part so that said spring exerts a force in the direction of the first end of the coaxial bushing connector.

3. The coaxial bushing connector of claim 2 including having the inner conductor part on the first end of the coaxial bushing connector configured as a hollow cylinder and the inner conductor bushing arranged passing axially through said hollow cylinder.

4. The coaxial bushing connector of claim 2 wherein an inside diameter of the inner conductor bushing complies with the BNC standard.

5. The coaxial bushing connector of claim 3 wherein an inside diameter of the inner conductor bushing complies with the BNC standard.

6. A coaxial plug connector for connecting with a coaxial bushing connector, said coaxial plug connector comprising an outer conductor part and an inner conductor part, wherein the outer conductor part complies with the BNC standards, characterized in that the inner conductor part and the outer conductor part of the coaxial plug connector are configured so that when the coaxial plug connector is plugged into the coaxial bushing connector they complement the coaxial bushing connector outer conductor part and the coaxial bushing connector inner conductor part such that at least in the region between the electrical and mechanical reference plane and the first end of the coaxial bushing connector an approximately 7-mm coaxial line is formed, wherein the one inner diameter of an outer conductor of the outer conductor part is 7 mm and an outside diameter of an inner conductor of the inner conductor part is approximately 3.05 mm and between the inner and the outer conductor air is present as a dielectric.

7. The coaxial plug connector of claim 6, including having the inner conductor part and the outer conductor part of the coaxial plug connector configured so that with the coaxial plug connector plugged into the coaxial bushing connector they form a 7-mm coaxial line over the entire axial length from the electrical and mechanical reference plane of the coaxial bushing connector up to an end of the coaxial plug connector facing away from the coaxial bushing connector.

8. A combination of a coaxial plug connector and a coaxial bushing connector comprising:

a coaxial plug connector including an outer conductor part and an inner conductor part, wherein the outer conductor part complies with the BNC standards, characterized in that the inner conductor part and the outer conductor part of the coaxial plug connector are configured so that when the coaxial plug connector is plugged into the coaxial bushing connector they complement the coaxial bushing connector outer conductor part and the coaxial bushing connector inner conductor part; and a coaxial bushing connector comprising an outer conductor part, an inner conductor part, a first end for attaching the coaxial plug connector, a second end opposite the first end, in particular for connecting to a coaxial cable or to a printed circuit board, and an electrical and mechanical reference plane, whereby the outer conductor part between the first end of the coaxial bushing connector and the electrical and mechanical reference plane complies with the BNC standard, characterized in that at least between the electrical and mechanical reference plane on the one hand and the second end of the coaxial bushing connector on the other hand the inner conductor part and the outer conductor part form between them and over at least one predefined segment a 7-mm coaxial line, wherein the inside diameter of an outer conductor of the outer conductor part is approximately 7 mm and an outside diameter of an inner conductor of the inner conductor part is 3.05 mm and air is present as a dielectric between the inner and outer conductors.

* * * * *